US007568611B2

(12) United States Patent
Cargile, Jr.

(10) Patent No.: US 7,568,611 B2
(45) Date of Patent: Aug. 4, 2009

(54) CARTON HAVING STACKING STRENGTH-ENHANCING FEATURE

(75) Inventor: John W. Cargile, Jr., Decatur, GA (US)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 747 days.

(21) Appl. No.: 10/836,171

(22) Filed: Apr. 30, 2004

(65) Prior Publication Data

US 2005/0242165 A1 Nov. 3, 2005

(51) Int. Cl.
*B65D 25/04* (2006.01)
*B65D 17/28* (2006.01)

(52) U.S. Cl. ..... 229/120.18; 229/122; 229/127; 229/242; 229/915

(58) Field of Classification Search ..... 229/120.17, 229/120.18, 122, 127, 240, 241, 242, 915, 229/235; 206/427
See application file for complete search history.

(56) References Cited

U.S. PATENT DOCUMENTS

| | | | | | |
|---|---|---|---|---|---|
| 1,795,293 | A | * | 3/1931 | Boeye | 229/120.04 |
| 2,908,437 | A | * | 10/1959 | Wiedenmeier | 206/320 |
| 3,095,137 | A | | 6/1963 | Reynolds | |
| 3,184,136 | A | | 5/1965 | Forbes, Jr. | |
| 3,226,007 | A | | 12/1965 | Thies et al. | |
| 3,367,487 | A | * | 2/1968 | Dwyer, Jr. | 206/449 |
| 3,465,946 | A | * | 9/1969 | Johnson | 206/521 |
| 3,599,858 | A | * | 8/1971 | Samsing | 229/229 |
| 3,669,251 | A | | 6/1972 | Phillips, Jr. | |
| 4,396,145 | A | * | 8/1983 | Ditton | 229/120.17 |
| 4,676,429 | A | * | 6/1987 | Crowe et al. | 229/109 |
| 4,726,471 | A | | 2/1988 | Whately et al. | |
| 5,350,062 | A | * | 9/1994 | Takiguchi et al. | 206/316.2 |
| 5,622,309 | A | * | 4/1997 | Matsuda et al. | 229/243 |
| 5,722,584 | A | | 3/1998 | Fujiwara | |
| 5,881,884 | A | | 3/1999 | Podosek | |
| 5,927,498 | A | | 7/1999 | Saam | |
| 6,209,786 | B1 | * | 4/2001 | Yelton et al. | 229/241 |
| 2003/0164317 | A1 | * | 9/2003 | Fujiwara | 206/425 |

FOREIGN PATENT DOCUMENTS

| | | |
|---|---|---|
| FR | 1501894 | 9/1966 |
| GB | 1206773 | 9/1970 |
| JP | 11-105855 | 4/1999 |

* cited by examiner

*Primary Examiner*—Gary E Elkins
(74) *Attorney, Agent, or Firm*—Tsugihiko Suzuki

(57) ABSTRACT

A carton having a dispensing feature adapted for permitting the removal of articles from within the carton. Top and bottom opposed walls are interconnected by a pair of side walls to form a tubular body. An article dispenser is provided by a removable portion defined by an opening in the carton for exposing articles for removal. The removable portion is at least partially defined by a frangible line extending across each side wall to opposite side edges of the bottom wall. A portion of the frangible line extends at least partially along the adjacent end edge of the bottom wall and then extends to the opposite side edges of the bottom wall. A buttress arrangement for enhancing the stacking strength of the carton is formed from the distal portion of at least one side end flap.

22 Claims, 9 Drawing Sheets

CARTON HAVING STACKING STRENGTH-ENHANCING FEATURE

TECHNICAL FIELD

The present invention relates generally to cartons for use in packaging articles and, more particularly, relates to a dispensing carton whose stacking strength is enhanced by a special arrangement of an end closure structure and/or a frangible line.

BACKGROUND OF THE INVENTION

Cartons are useful for allowing consumers to purchase, transport and store a desired quantity of articles. For the convenience of the consumers, some cartons have dispensers which allow the articles to be dispensed from the carton while continuing to encase the remaining articles. A portion of the carton is torn out to form an opening from which articles may be removed.

However, some articles are flexible and/or deformable such as juice pouches. Such articles tend to get easily rearranged and crushed within the carton. Moreover, not all cartons have sufficient strength to physically protect the contents when arranged in a stacked condition. Dispensers, in particular, tend to break open unintentionally when the cartons are subject to compression. What is needed, therefore, is an improved dispensing carton for packaging flexible or deformable articles. The improved carton should have good stacking strength as well as an improved dispensing feature to protect the contents when stored or displayed with like cartons in a stacked condition.

SUMMARY OF THE INVENTION

The present invention provides a carton with an improved article dispenser which utilizes end flaps to increase the structural integrity of the carton while continuing to facilitate easy access to the articles within the carton. Flexible and/or deformable articles such as stand-up pouches may be retained within the carton in an organized manner.

Generally described, top and bottom opposed walls are hingedly interconnected by a pair of side walls to form a tubular body. An end closure structure is provided to at least partially close each end of the tubular body. A buttress arrangement is provided by each end closure structure. Each buttress arrangement is disposed within the interior of the carton and extends vertically between the top and bottom walls to enhance the stacking strength of the carton. An article dispenser is provided at one or both of the opposite ends of the carton. The article dispenser is provided by a removable portion of the carton to define an opening for exposing articles for removal from the carton. The removable portion is defined by a frangible line extending across the top wall at a distance spaced from at least one end of the tubular body. The frangible line further extends from the top wall across each side wall toward the bottom wall to a point on the fold line between each side wall and the bottom wall. The point on each fold line is positioned at a distance from the one end to control undesired tear of the side walls along the frangible line when the carton undergoes vertical compression.

In a preferred embodiment of the invention, each end closure structure may include a pair of side end flaps joined to the side walls respectively. Each side end flap may include a proximal portion hingedly connected to the respective side wall and extends toward the other side wall. One of the side end flaps further includes a distal portion hingedly connected to the respective proximal portion. The distal portion of the one side end flap may extend into the interior of the carton to form the respective buttress arrangement. The other side end flap may also include a distal portion extending into the interior of the carton. The distal portions of the side end flaps of each end closure structure may be disposed in a face-to-face contacting relationship to form the respective buttress arrangement. The distal portion of one or each side end flap may be positioned such that that distal portion is disposed between the articles within the carton to serve as a partition. These distal portions extends all the way between the top and bottom walls to be in abutment at their upper and lower ends on the top and bottom walls.

In another preferred embodiment, the buttress arrangement at the one end of the tubular body may be removable from the carton along with the removable portion to permit the packaged articles to be dispensed from the carton.

In a still another embodiment, the frangible line may extend across each side wall at a distance spaced from the one end of the tubular body.

In a still further embodiment, the frangible line may further extend from the point on each fold line to the end edge of the bottom wall at the one end of the tubular body and still further extend at least partially along the end edge of the bottom wall to form an endless line. The frangible line may extend entirely along the end edge of the bottom wall and further along part of each fold line between the respective point and the end edge of the bottom wall. Alternatively, the frangible line may extend along part of the end edge. In this alternative arrangement, each portion of the frangible line that connects between the respective point and the end edge may be formed in the bottom wall. These portions of the frangible line extend divergently from the end edge to the respective points.

In a still further preferred embodiment, the removable portion may be defined by a portion of the top wall, a portion of each opposing side walls, and a portion of the respective end closure structure. The removable portion may be hingedly connected to the bottom wall along a portion of the frangible line extending along the end edge of the bottom wall.

The present invention in another aspect provides a carton comprising top and bottom opposed walls hingedly interconnected by a pair of side walls to form a tubular body, an end closure structure for at least partially closing each end of the tubular body, and an article dispenser provided at one of the opposite ends by a removable portion of the carton. The removable portion is at least partially defined by a frangible line that comprises first, second, third and fourth portions. The first portion is formed in the top wall and extends between the opposite side edges of the top wall at a distance spaced from the one end. The second portion is formed in one of the side walls and extends from one of the side edges of the top wall to a point on the lower edge of the one side wall. The third portion is formed in the other side wall and extends from the other side edge of the top wall to a point of the lower edge of the other side wall. The fourth portion extends at least partially along the end edge of the bottom wall at the one end of the tubular body such that the second and third portions are interconnected by the fourth portion. Each point on the lower edge of each side wall is positioned at a distance from the one end of the tubular body to control undesired tear of the side walls along the frangible line when the carton undergoes vertical compression.

In a preferred embodiment of this aspect of the invention, the second and third portions may be disposed at a distance spaced from the one end of the tubular body.

In another preferred embodiment, the fourth portion may extend entirely along the end edge of the bottom wall and further along part of the lower edge of each side wall between the respective point and the end edge.

In a further preferred embodiment, the fourth portion may extend in part along the end edge of the bottom wall and in part formed in the bottom wall to connect each point to the end edge of the bottom wall. The sub-portions of the fourth portion connecting between the points to the end edge may extend divergently from the end edge to the respective points.

In a further preferred embodiment, the removable portion may be defined by a portion of the top wall, a portion of each side wall, and a portion of the respective end closure structure. The removable portion may be hingedly connected to the bottom wall along part of the fourth portion extending along the end edge of the bottom wall.

The present invention in a still another aspect provides a carton comprising top and bottom opposed walls hingedly interconnected by a pair of side walls to form a tubular body, an end closure structure for at least partially closing each end of the tubular body, and a buttress arrangement provided by each end closure structure. Each buttress arrangement is disposed within the interior of the carton and extends vertically between the top and bottom walls to enhance the stacking strength of the carton. Each end closure structure comprises a pair of side end flaps joined to the side walls respectively. Each side end flaps of each end closure structure comprises a pair of proximal and distal portions. The proximal portion is hingedly connected to the respective side wall whereas the distal portion is hingedly connected to the respective proximal portion. The proximal portions of the side end flaps extend from the side walls toward each other while the distal portions extending from the respective proximal portions into the interior of the carton. These distal portions are disposed in a face-to-face contacting relationship with each other to form the respective buttress arrangement. Each side end flap includes a vertical fold line dividing that side end flap into the distal and proximal portions. The distal portion has a horizontal transverse size greater than that of the proximal portion.

In a preferred embodiment of this aspect of the invention, each buttress arrangement may be positioned such that it is disposed between articles within the carton to serve as a partition. Each distal portion of each buttress arrangement may extend all the way between the top and bottom walls to be in abutment at its upper and lower ends on the top and bottom walls.

The foregoing has broadly outlined some of the more pertinent aspects and features of the present invention. These should be construed to be merely illustrative of some of the more prominent features and applications of the invention. Other beneficial results can be obtained by applying the disclosed information in a different manner or by modifying the disclosed embodiments. Accordingly, other aspects and a more comprehensive understanding of the invention may be obtained by referring to the detailed description of the exemplary embodiments taken in conjunction with the accompanying drawings, in addition to the scope of the invention defined by the claims.

DETAILED DESCRIPTION

Figure 1:
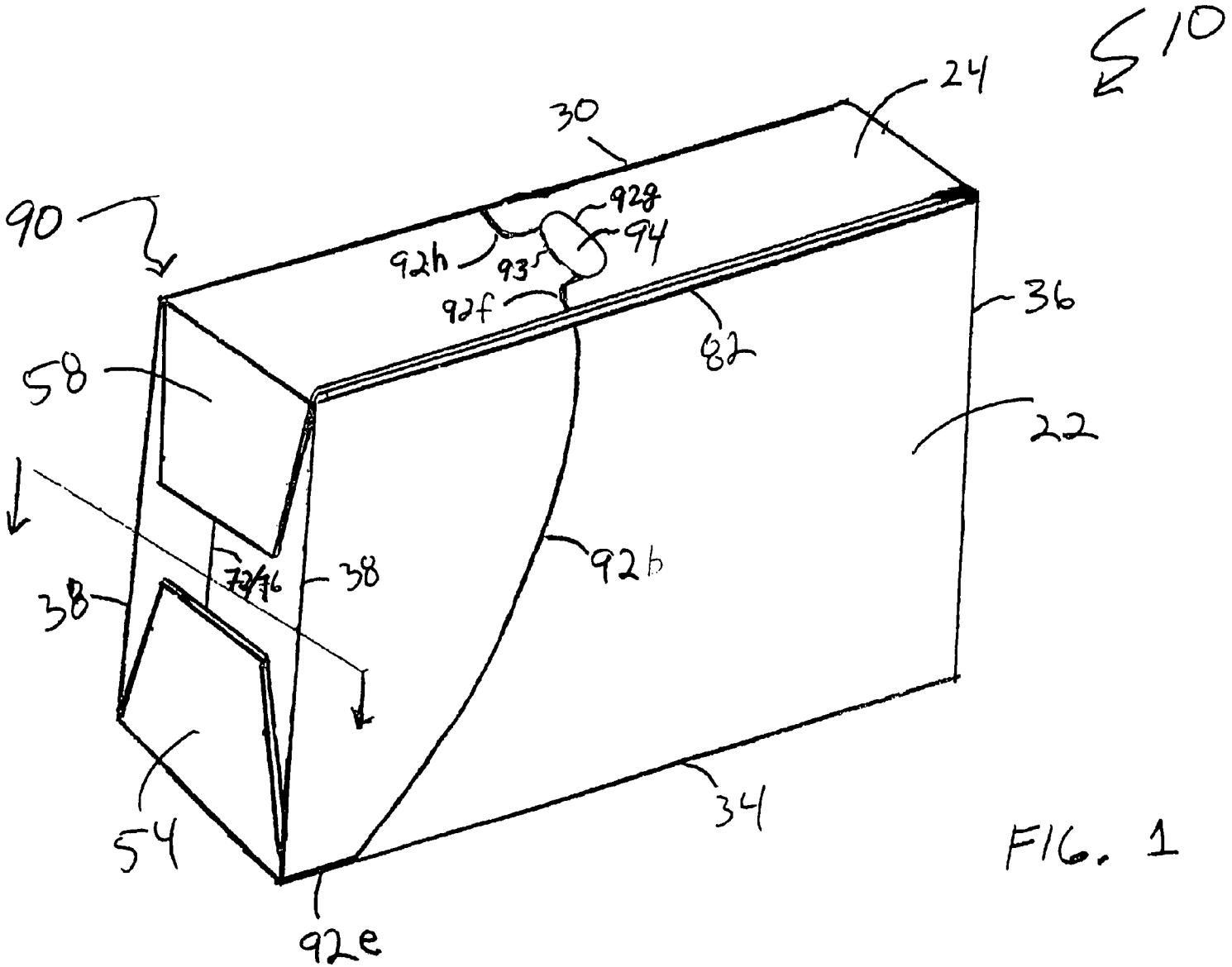
FIG. 1 illustrates a perspective view of one embodiment of a carton of the present invention.

Referring now to the drawings in which like numerals indicate like elements throughout the several views, the drawings illustrate exemplary embodiments of cartons 10 (FIG. 1) and 12 (FIG. 9) of the present invention. In these embodiments, the cartons 10 and 12 are designed for packaging and dispensing articles "A" which may be beverage pouches made, for example, of a plastic-aluminum laminated film. An example of such a pouch is disclosed in U.S. Pat. No. 5,927,498 which is hereby included by reference.

Figure 2:
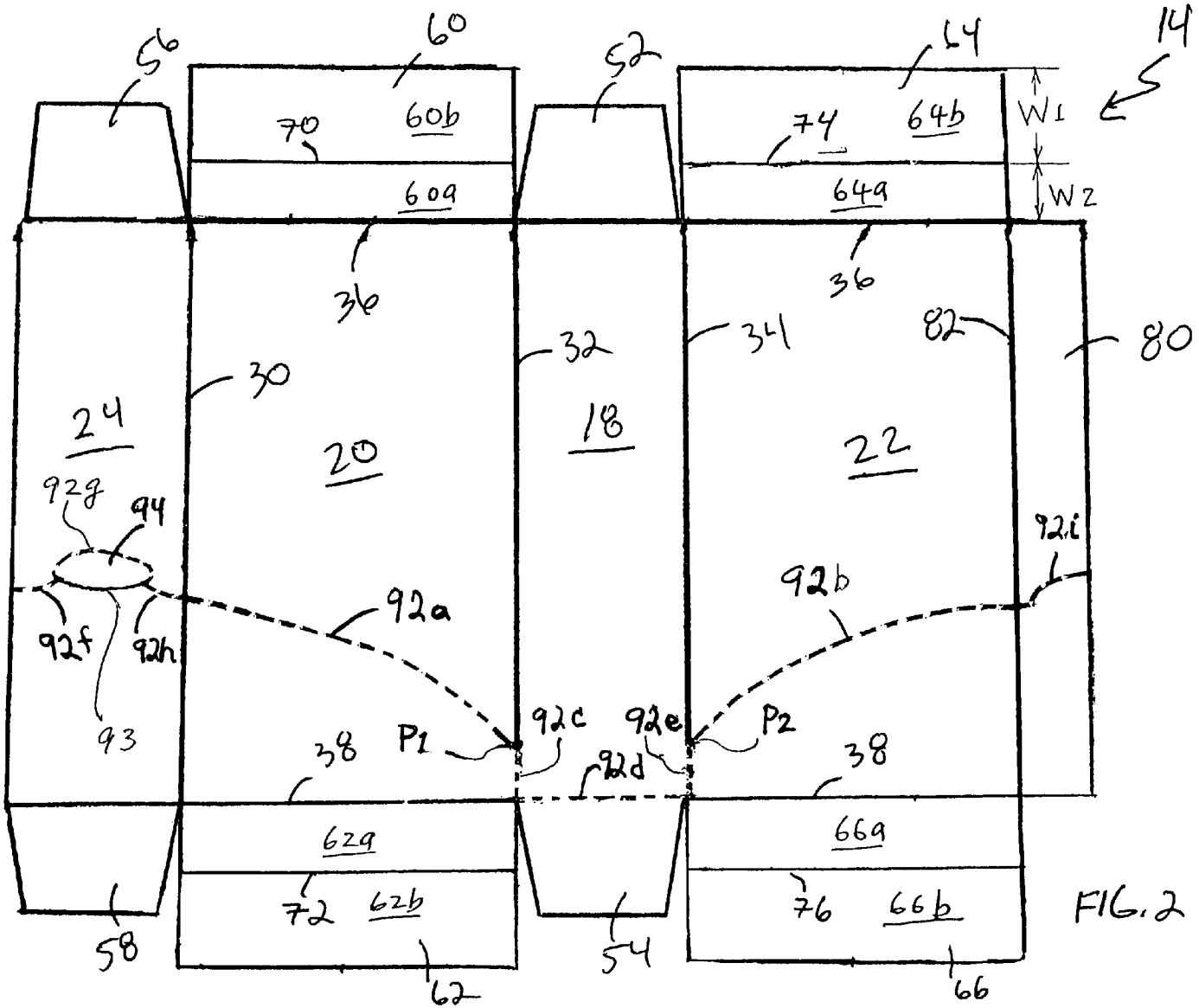
FIG. 2 illustrates a plan view of a blank for forming the carton of FIG. 1.

Generally described, the cartons 10, 12 are formed from foldable sheet material such as paperboard. Carton 10 shown in FIG. 1 is formed from a single blank 14. The blank 14 is configured as shown in FIG. 2 and includes at least four primary panels for forming the carton 10. The primary panels of the blank 14 are a top wall 24, a first side wall 20, a bottom wall 18 and a second side wall 22. These panels 24, 20, 18 and 22 are hingedly connected in series one to the next along fold lines 30, 32 and 34. The top wall 24 is hingedly connected to the first side wall 20 by fold line 30. The first side wall 20 is then hingedly connected to the bottom wall 18 by fold line 32. The bottom wall 18 is then hingedly connected to the second side wall 22 by fold line 34. Each of the panels 18, 20, 22 and 24 is provided with opposing end flaps that are connected to the respective primary panel along transverse fold lines 36 and 38. Fold lines 36 and 38 each extends substantially the full length of the blank 14.

Still referring to FIG. 2, the opposing end flaps include opposing bottom end flaps 52 and 54, opposing top end flaps 56 and 58 and opposing side end flaps 60, 62; and 64, 66. The end flaps 52, 56, 60 and 64 extend outward from the transverse fold line 36 while the end flaps 54, 58, 62 and 66 extend outward from the transverse fold line 38.

Side end flaps 60, 62, 64 and 66 include medial fold lines 70, 72, 74 and 76, respectively. The medial fold line of each side end flap divides that end flap into a pair of proximal and distal portions 60*a*, 60*b*; 62*a*, 62*b*; 64*a*, 64*b*; and 66*a*, 66*b*. Preferably, as shown in FIG. 2, the width (or horizontal transverse size) W1 of each of the distal portions 60*b*, 62*b*, 64*b*, and 66*b* is greater than the width (or horizontal transverse size) W2 of each of the proximal portions 60*a*, 62*a*, 64*a*, and 66*a*. Stated differently, the distance between transverse fold line 36 or 38 and each medial fold line is less than the distance between that medial fold line and the free end edge of the respective distal portion.

The articles "A" are preferably stand-up pouches which may be deformable and are made from a flexible material such as a plastic-aluminum laminated film. In the empty condition, each article "A" is flat. In the filled condition, each article "A" has a flat bottom and generally rectangular front and rear panels. The front and rear panels extend from the bottom into a mutual contacting and sealed relationship at the top of the pouch. The bottom of each pouch is in the form, generally, of a hexagon. Each side wall of each pouch has a generally triangular configuration with its base being at the bottom. Therefore, the bottom of each pouch is considerably wider than the top when viewed from the side.

Figure 3:
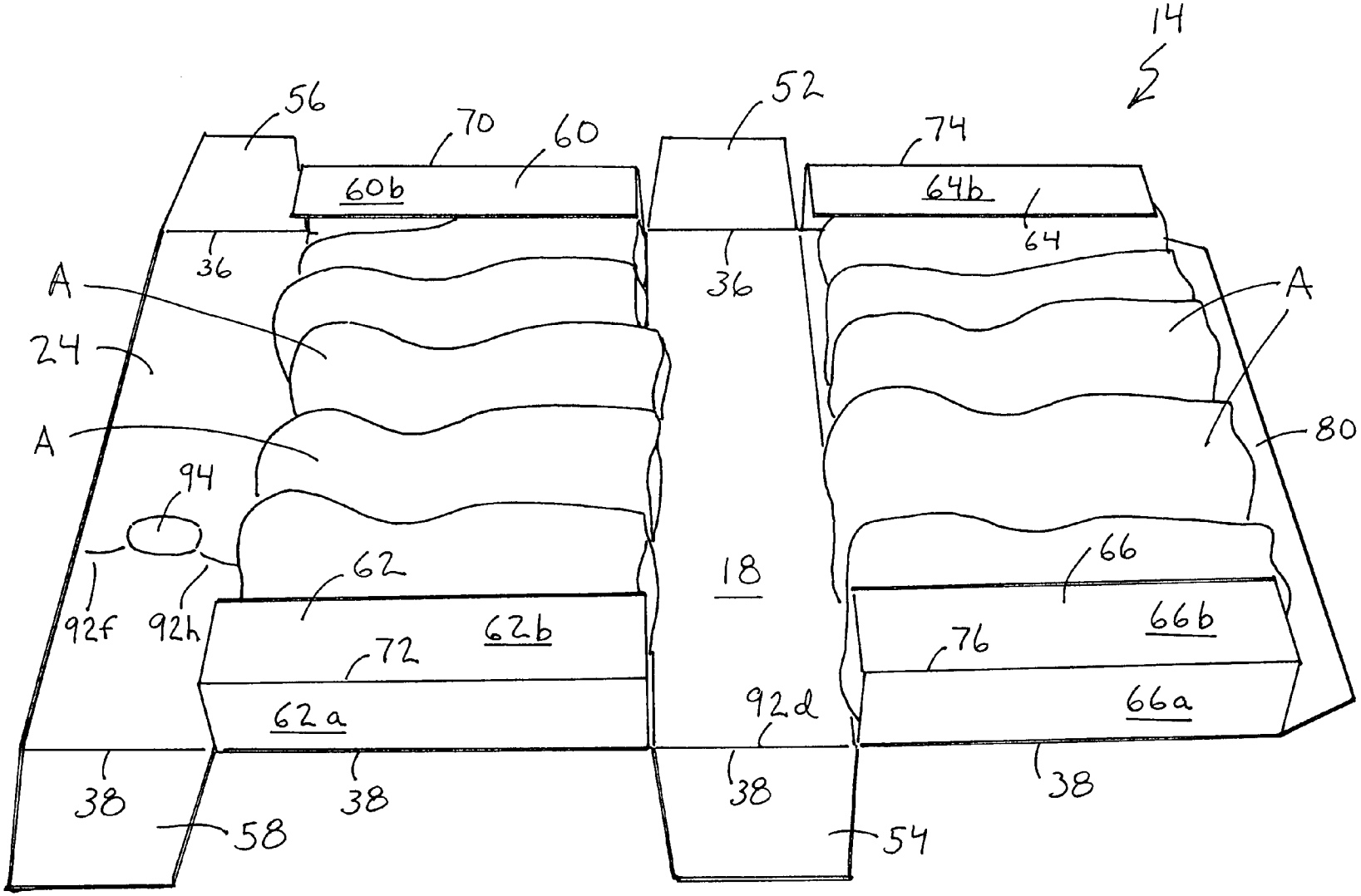
FIG. 3 illustrates a perspective view of the blank of FIG. 2, showing a first step for loading and erecting the carton, wherein articles are placed on the side walls.
Figure 6:
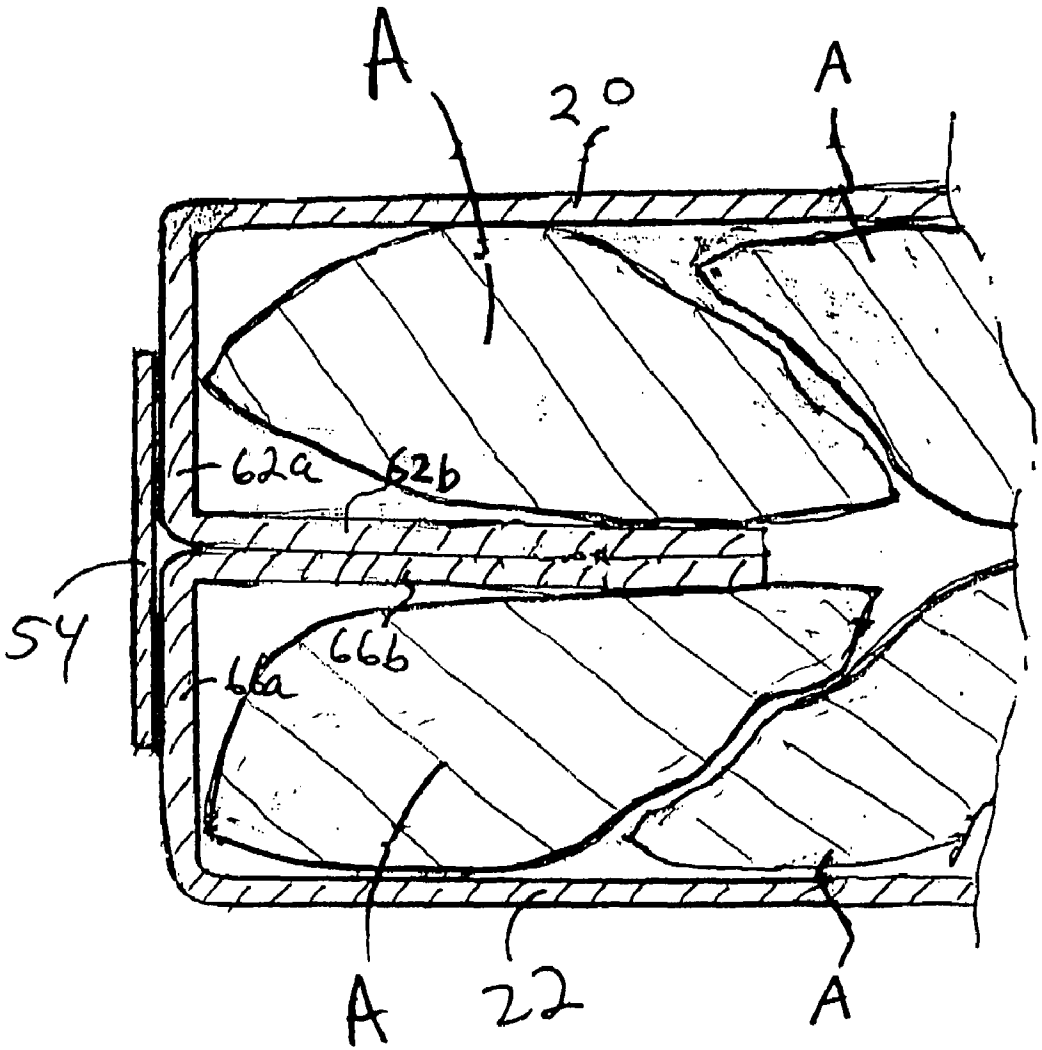
FIG. 6 illustrates a fragmentary cross-sectional view taken along line VI-VI of FIG. 1.

Prior to erecting the carton 10, two separate rows of filled pouches "A" are arranged on the side walls 20, 22 of blank 14 as shown in FIG. 3. The two rows are placed on the side walls 20 and 22 respectively such that each pouch "A" lie on its front or rear panel. It is preferred that the bottoms of the pouches "A" in the left-hand side row as viewed in FIG. 3 face the tops of the pouches "A" in the right-hand side row. It is also preferred that the pouches "A" in each row are arranged one next to another in somewhat overlapping relationship as best illustrated in FIG. 6.

In order to erect the carton 10, the side end flaps 60, 62, 64 and 66 are folded upward along transverse fold lines 36 and 38 as shown in FIG. 3. Side end flaps 60, 62, 64 and 66 are then folded along the medial fold lines 70, 72, 74 and 76 respectively so that the proximal portions 60*a*, 62*a*, 64*a* and 66*a* remain in the vertical positions and the distal portions 60*b*, 62*b*, 64*b* and 66*b* generally horizontally extend inwardly of the blank over the adjacent end pouches "A" of the respective rows. The folding of the side end flaps 60, 62, 64 and 66 secures the end pouches "A" in position against the side walls 20, 22 and thus the intermediate pouches in each row are also retained in position during the course of the succeeding carton-erecting process due to their overlapping arrangement discussed previously.

Figure 4:
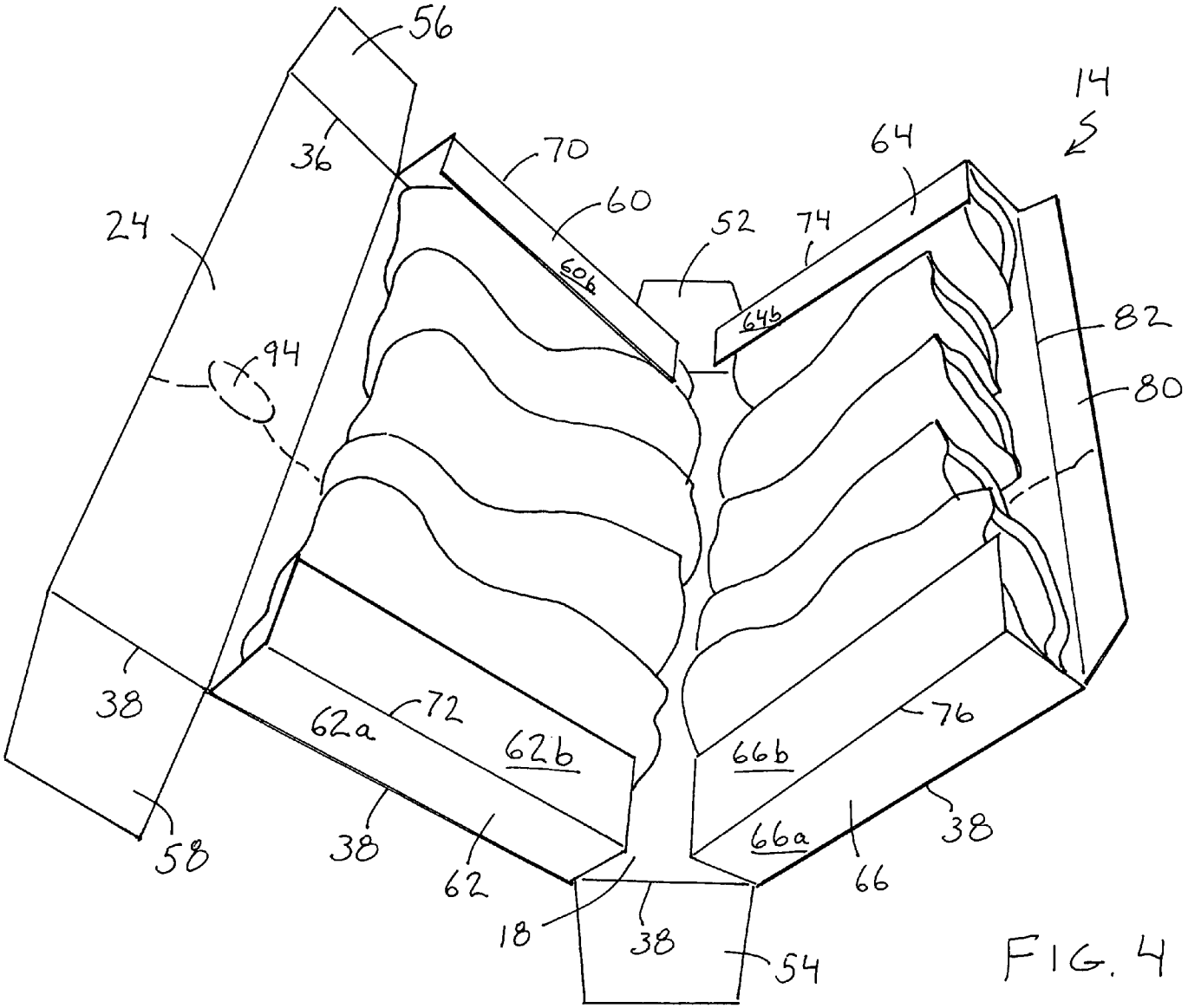
FIG. 4 illustrates a perspective view of the blank of FIG. 3, showing another carton-erecting step wherein the side walls are upwardly moved toward each other from the positions shown in FIG. 3.
Figure 5:
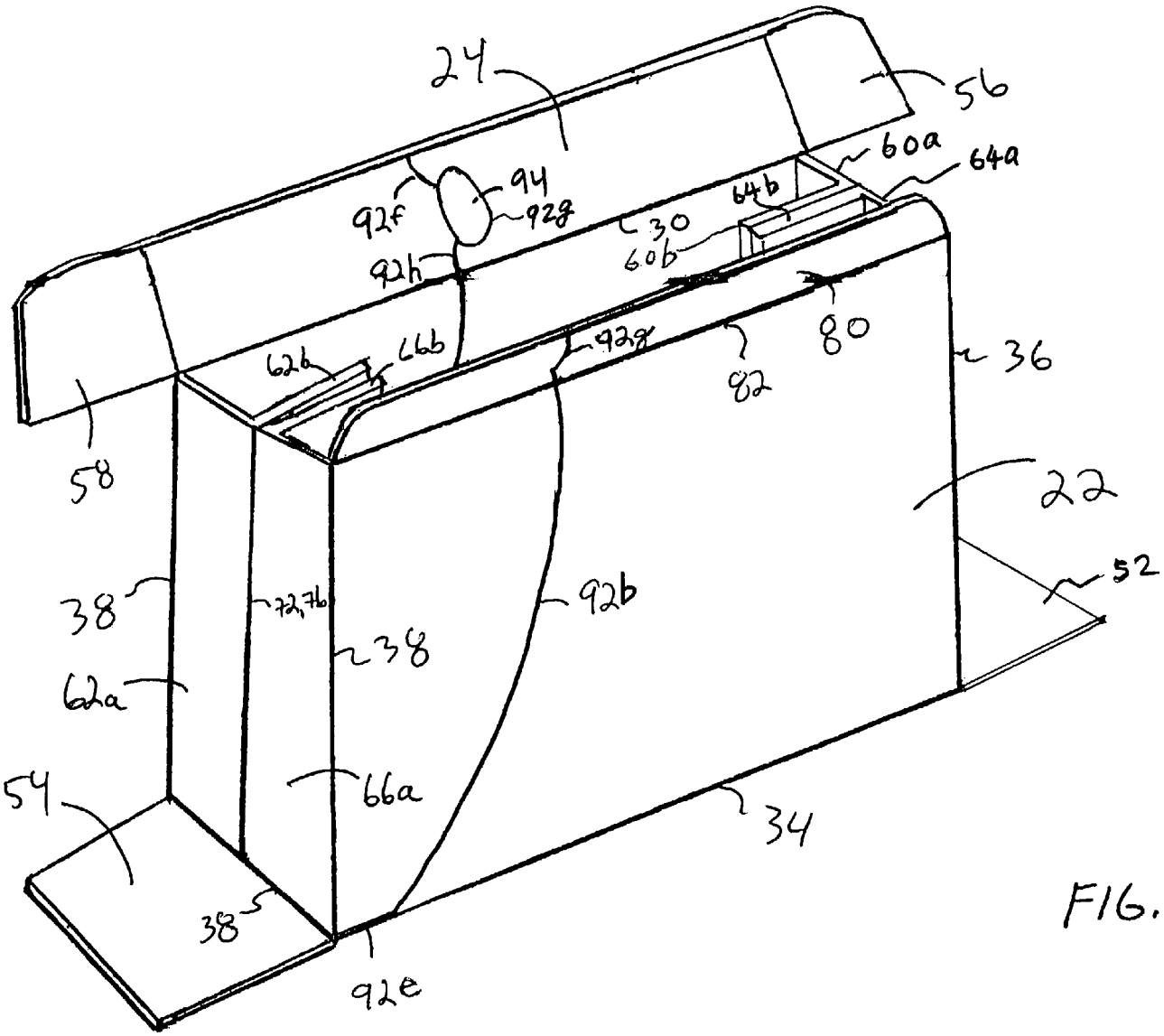
FIG. 5 illustrates a perspective view of the blank of FIG. 4, showing a still another carton-erecting step wherein the side walls are moved to the vertical position and the carton is partially erected.

Following the above folding step, the side walls 20 and 22, with the rows of pouches "A" held in place, are folded toward each other along fold lines 32 and 34 in order to further erect the carton. This is best illustrated in FIG. 4. This further erecting step eventually brings the side walls 20, 22 into the upright positions as shown in FIG. 5. When the side walls 20 and 22 are in the upright positions, the pouches "A" in one row become nested with the pouches "A" in the other row in such a manner that the bottoms of the pouches in the one row face the tops of the pouches in the other row. In FIG. 5, the bottoms of the pouches in the left-hand side row and the tops of the pouches in the right-hand side row rest upon the bottom wall 18.

From the condition of FIG. 5, the top wall 24 and the edge flap 80 are folded down to their respective horizontal positions and glued or otherwise secured to each other. The edge flap 80 is hingedly connected to the second side wall 22 along fold line 82. After that, the upper and lower end flaps 56 and 52 are folded downward and upward respectively and glued to the adjacent proximal portions 60*a* and 64*a* to provide an end closure structure for closing the rear end of the carton. The upper and lower end flaps 58 and 54 are also similarly folded and secured to the adjacent proximal portions 62*a* and 66*a* to provide the other end closure structure for closing the forward end of the carton. A fully erected carton is thus provided as shown in FIG. 1. In the fully enclosed carton, the pouches "A" occupy a minimum space because the pouches "A" in the one row are nested with those of the other row and also because the pouches in each row are in the overlapping condition.

FIG. 6 is a fragmentary cross-sectional view of the carton of FIG. 1 and shows the condition of the inside of the fully erected carton. In FIG. 6, the distal portions 62*b* and 66*b* of the end closure structure at the forward end are disposed in a face-contacting relationship between the end pouches "A". In fact, the distal portions 60*b* and 64*b* are also in a face contacting relationship as suggested in FIG. 5 and disposed between the end pouches at the rear end of the carton. These distal portions 62*b*, 66*b*; and 60*b*, 64*b* extend all the way between the top and bottom walls 24 and 18 to provide buttress arrangements for enhancing the stacking strength of the carton, that will be discussed later in more details. As viewed in FIG. 1, the fold lines 30, 32, 34 and 82 form the horizontal longitudinal edges of the carton 10 while the transverse fold lines 36 and 38 form the vertical edges and horizontal transverse edges of the carton 10.

As shown in FIGS. 1 and 6, the side end flaps and the upper and lower end flaps at each end of the carton provide the respective end closure structure. Particularly, the distal portions of the side end flaps of each end closure structure are arranged in a face contacting relationship while extending inward, at an angle relative the corresponding proximal end portions. This is best shown in FIG. 6 wherein the distal end portions 62 and 66*a* extend into the internal space of the carton at about 90 degrees with respect to the proximal portions 62*a* and 66*a*. Referring further to FIG. 6, the distal end portions 62*b* and 66*a* are disposed between the adjacent end pouches "A" of the two rows to serve as a partition or spacer between the adjacent end pouches "A". The distal portions 60*b* and 64*b* of the other end closure structure may also be arranged in a face contacting relationship and/or may be disposed between the respective end pouches "A" of the two rows to serve as another partition or spacer between the respective end pouches "A". Furthermore, the distal portions of each end closure structure extend all the way between the top and bottom walls 24 and 18 and provide a buttress arrangement for enhancing the stacking strength of the carton. The upper and lower ends of each buttress arrangement are in direct abutment on the top and bottom walls 24 and 18 respectively to be able to bear the load transmitted from the top and bottom walls when the carton is arranged with like cartons in a stacked condition.

As shown in FIG. 6, the horizontal transverse size or width W1 (see FIG. 2) of each distal portion is greater than the horizontal transverse or width of the corresponding proximal portion. This arrangement allows the distal portions to provide sturdier buttress arrangements for achieving greater stacking strength. The buttress arrangements also provide greater structural integrity to the carton 10. Because of the buttress arrangements, the carton 10 may sustain greater weights when stacked within a group of like cartons.

The carton 10 of the present invention also includes a removable portion 90 at the forward end of the carton. The removable portion 90 is defined by a frangible line consisting of line portions 92*a*-92*i*. FIG. 2 best illustrates the frangible line that provides an endless tear line when the carton is set up. The frangible line 92*a*-92*i* may be a line of severance or any other weakened line that facilitates separation along the length of the frangible line. It is contemplated that the tear line includes, but is not limited to, a perforation, a line of short slits, a line of half cut, a combination of slits and score lines, or the equivalent.

Referring to FIG. 2, the portion 92*a* is formed in the side wall 20. The portion 92*a* extends between the side edge of the top wall 24, defined by fold line 30, to an intermediate point P1 along the lower edge (32) of the side wall 20. The portion 92*a* is disposed at a distance from the adjacent end edge of the side wall 20 defined by the fold line 38. The point P1 is also spaced at a distance from the fold line 38. The lower end of the portion 92*a* at this location P1 is effective to prevent, or at least mitigate, undesired tear or rupture along the frangible line when the erected carton undergoes compression. Such compression would typically be applied to the carton while the carton is transported, stored and/or displayed in a stacked condition wherein a number of like cartons are stacked one on top of another. If the lower end of the portion 92*a*, for example, were located at the corner defined by the fold lines 32 and 38, undesired tear would tend to develop from the corner along the portion 92*a* when the carton undergoes compression. The portion 92*b* is formed in the side wall 22 in a similar manner to the portion 92*a*. The lower end of the portion 92*b* is located on the lower edge (34) of the side wall 22 at an intermediate position P2 that is spaced from the fold line 38 for the same reason as discussed above for the point P1.

Still referring to FIG. 2, the line portion that interconnects the portions 92*a* and 92*b* consists of three sub-portions 92*c*, 92*d* and 92*e*. The sub-portion 92*c* is aligned or collinear with a portion of the fold line 32 and extends from the point P1 to the transverse fold line 38. The sub-portion 92*e* is aligned or collinear with a portion of the fold line 34 and extends from the point P2 to the transverse fold line 38. The sub-portion 92*d* is aligned or collinear with a portion of the fold line 38 and extends between the fold lines 32 and 34 along the entire length of the adjacent end edge of the bottom wall 18.

Referring further to FIG. 2, the line portion that extends across the top wall 24 consists of three sub-portions 92*f*, 92*g* and 92*h*. The sub-portion 92*f* extends from one of the side edges of the top wall 24 to a tear initiation tab 94. The sub-portion 92*h* extends from the other side edge (30) of the top wall 24 to the tear initiation tab 94. The tear initiation tab 94 is defined in the top wall 24 by the sub-portion 92*g* and a fold line 93 such that the sub-portion 92*g* interconnects the sub-portions 92*f* and 92*h*. The sub-portion 92*h* is arranged continuous with the portion 92*a*.

The portion 92*i* extends across edge flap 80 such that it is continuous with the portion 92*b*. The portion 92*i* underlies sub-portion 92*f* when the carton 10 is erected and, therefore, cooperates with portion 92*f* when the removable portion 90 is removed from the carton 10.

Figure 7:
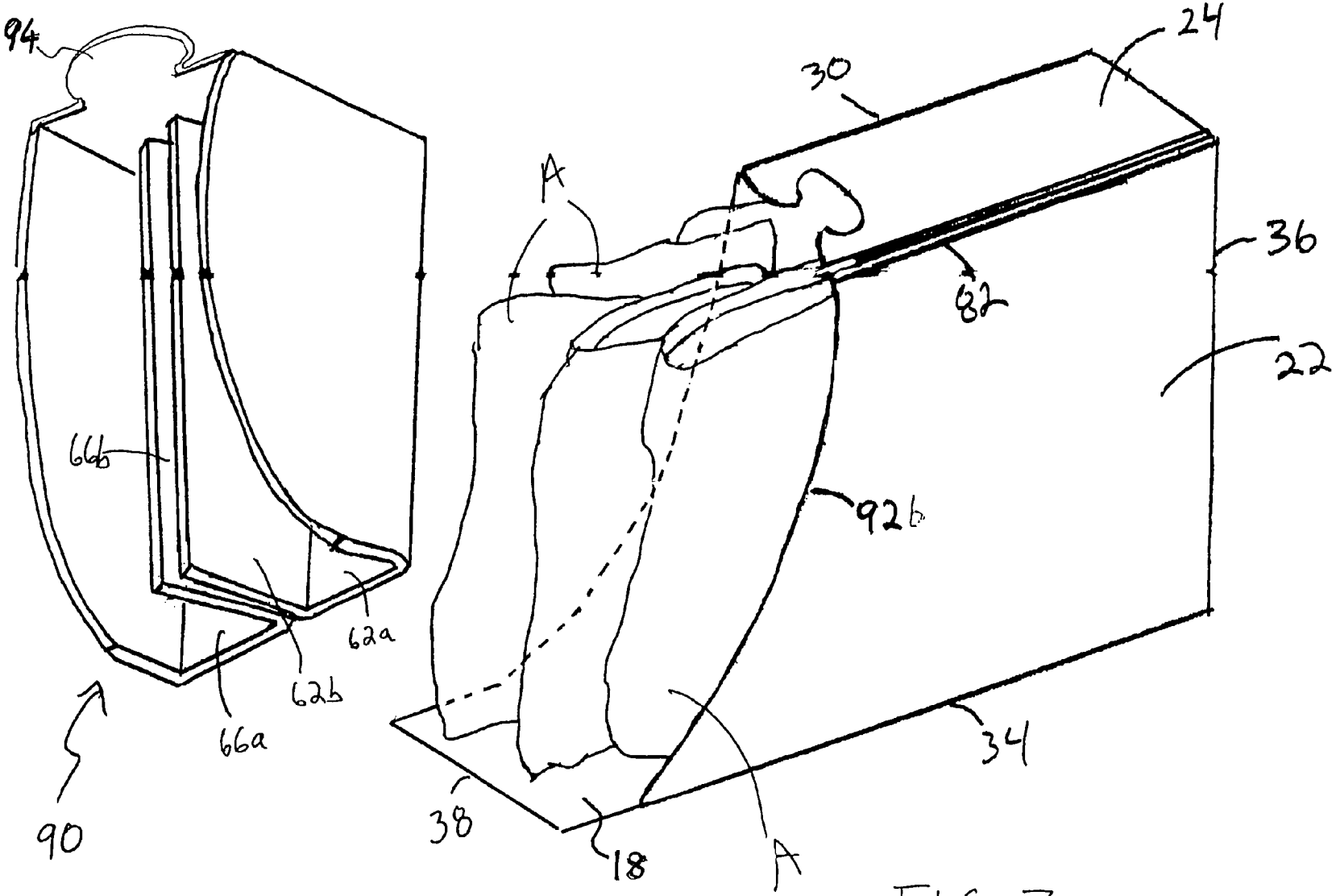
FIG. 7 is a perspective view of the carton of FIG. 1, showing a portion removed for dispensing articles.

The line portions 92*a*-92*i* in a set-up condition cooperate with one another to form the endless frangible line that defines the periphery of the removable portion 90. To remove the removable portion 90 from the carton, a finger or fingers of a user are pressed against the tear initiation tab 94 and are thereby inserted into the aperture defined by the tab 94 that is thrust into the carton by the finger(s). The fingers are then engaged with the top panel 24 along the fold line 93 and pulled forwardly and downwardly away from the rear end of the carton to tear the carton along the frangible line. This pulling action may easily tear the carton entirely along the frangible line to separate the removable portion 90 from the carton. The sub-portion 92*d* may optionally remain unbroken to keep the removable portion 90 attached to the remainder of the carton. FIG. 7 illustrates the removable portion 90 fully separated from the carton 10 and then rotated to show the interior of the removable portion 90. As best illustrated in FIG. 7, the buttress arrangement provided by the distal portions 62*b*, 66*b* is also removed from the carton along with the removable portion 90.

Figure 8:
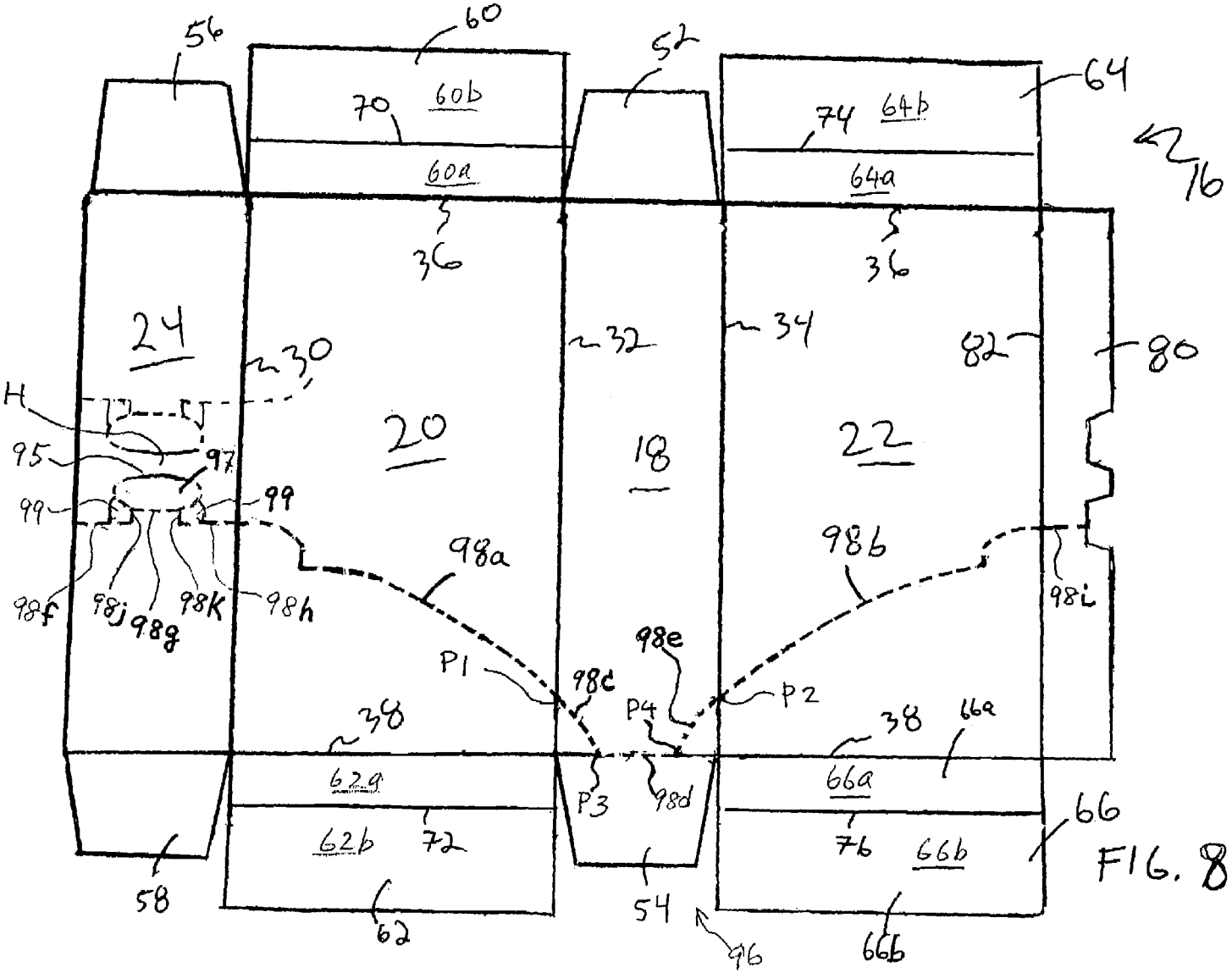
FIG. 8 is a plan view of a blank for forming a second embodiment of the carton of the present invention.
Figure 9:
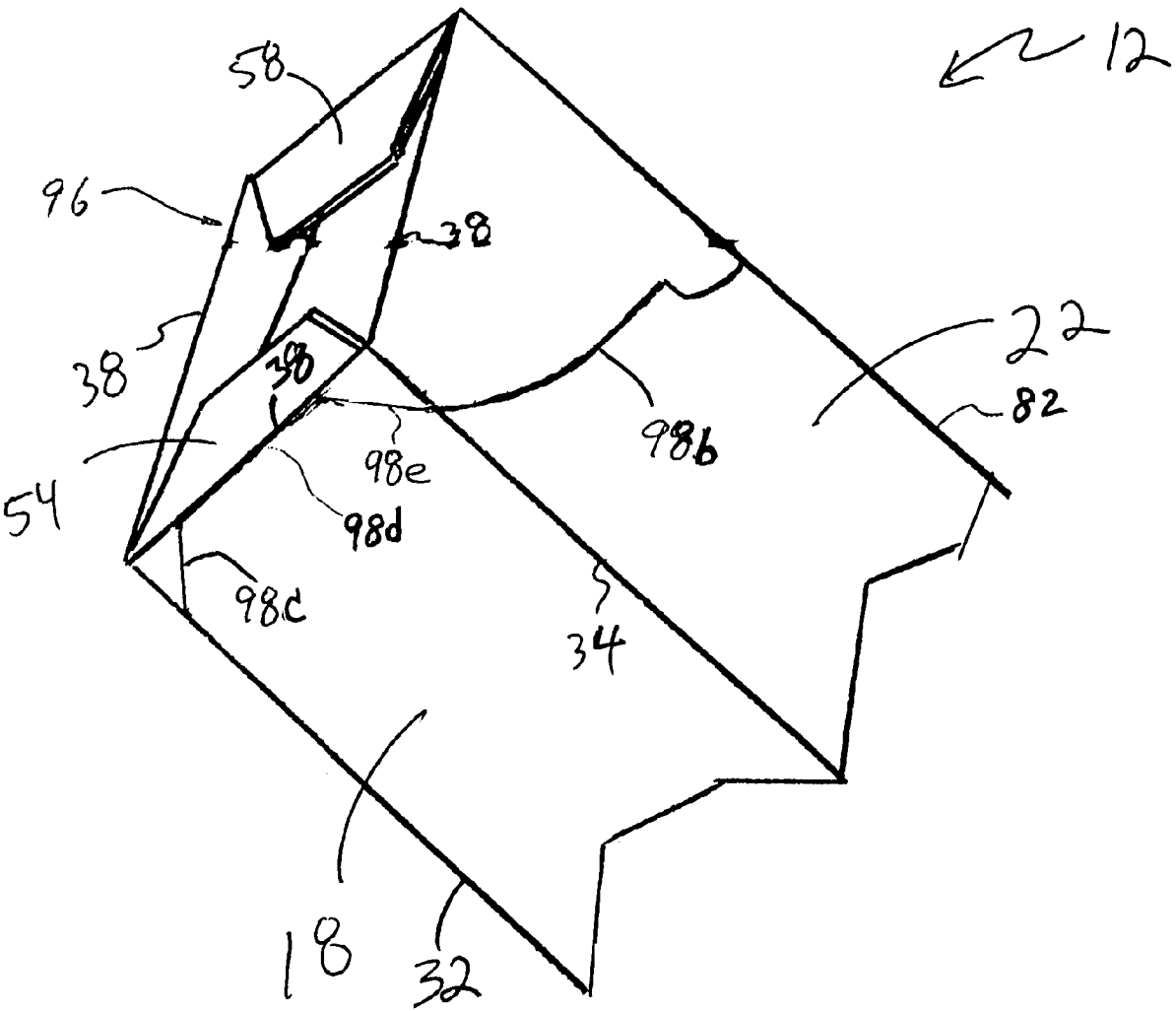
FIG. 9 illustrates a fragmentary perspective view of the carton of FIG. 8, showing the bottom wall, one of the end closure structures and one of the side walls.

FIGS. 8 and 9 illustrate a carton 12 that is an alternative embodiment of the present invention. FIG. 9 shows a carton that is formed from the blank 16 of FIG. 8. The carton 12 is similar to the carton 10 of the previous embodiment except for the details of the frangible line that is modified to provide a removable portion 96 that differs from the removable portion 90. As shown in FIG. 8, the removable portion 96 of carton 12 is defined by an endless frangible line that is formed near the forward end of the carton 12 by means of line portions 98*a*-98*i*. The frangible line 98*a*-98*i* may be of the same quality of the frangible line 92*a*-92*i* to facilitate separation along the length of the frangible line.

Each of the portions 98*a* and 98*b* in the side walls 20 and 22 is routed in part to define a crank shape, rather than smoothly curved all the way, because part of them serve also as tear lines for defining part of a carrying handle arrangement "H" (see FIG. 8). The details of the handle arrangement "H" is disclosed in U.S. Pat. No. 6,273,330 that is hereby incorporated by reference. Otherwise, the portions 98*a* and 98*b* are arranged similarly to the portions 92*a* and 92*b* in the previous embodiment to prevent, or at least mitigate, undesired tear or rupture along the frangible line when the erected carton undergoes compression.

In this embodiment, the line portion that interconnects the portions 98*a* and 98*b* consists also of three sub-portions 98*c*, 98*d* and 98*e*. However, the sub-portions 98*c* and 98*e* are not aligned with the fold lines 32 and 34 nor does the sub-portion 98*d* extend along the entire length of the respective end edge of the bottom wall 18. Instead, the sub-portion 98*d* extends along only a part of the end edge of the bottom wall 18 between two spaced points P3 and P4 along the end edge while the sub-portions 98*c* and 98*e* extend divergently from the points P3 and P4 to the points P1 and P2 respectively. Apparently, the sub-portions 98*c* and 98*e* are formed in the bottom wall 18. This arrangement of the sub-portions 98*c* and 98*e* is effective to facilitate development of the tear into the bottom panel 18 when the removable portion 96 is pulled away from the remainder of the carton. The separation of the removable portion 96 is thus facilitated by the divergent arrangement of the sub-portions 98*c* and 98*e*.

The line portion that extends across the top wall 24 consists of five sub-portions 98*f*, 98*g*, 98*h*, 98*j* and 98*k*. The sub-portion 98*f* extends from one of the side edges of the top wall 24 and interconnected with the sub-portion 98*g* by the sub-portion 98*j*. The sub-portion 98*h* extends from the other side edge (30) of the top wall 24 and interconnected to the sub-portion 98*g* by the sub-portion 98*k*. Apparently, these sub-portions 98*f*-98*h*, 98*j* and 98*k* serve also as weakened lines for defining part of the handle arrangement "H". The sub-portion 98*g* defines in the top wall 24 a handle flap 97 of the handle arrangement "H". The sub-portions 98*j* and 98*k* serve not only as tear lines but also as fold lines to define connector tabs 99 and 99 of the handle arrangement "H". The sub-portion 98*h* is arranged continuous with the portion 98*a*.

The portion 98*i* is arranged similarly to the sub-portion 92*i* of the previous embodiment and extends continuously with the portion 98*b* across the edge flap 80. The portion 98*i* underlies sub-portion 98*f* when the carton 12 is erected and, therefore, cooperates with the sub-portion 98*f* when the removable portion 96 is separated from the carton 12.

How to separate the removable portion 96 is also similar to the way the removable portion 90 is separated in the previous embodiment. A minor difference is that the handle flap 97 remains attached to the handle arrangement "H" along the fold line 95 when the flap 97 is folded inwardly either to initiate the separation of the removable portion 96 or to lift the carton by the handle arrangement "H".

It will be recognised that as used herein, directional references such as "top", "bottom", "base", "end", "side", "inner", "outer", "upper", "lower", "forward" and "rear" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a line of perforation, a line of short slits or their combination, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate only one or more than two rows of articles. The carton may be provided with two removable portions at its opposite ends respectively.

The present invention and its preferred embodiment relate to enhancing stacking strength of a fully enclosed carton. The invention serves as a useful dispensing carton that can be placed upon a surface or within a compartment such as a refrigerator or pantry. It will, however, be apparent and those skilled in the art will recognize that the present invention is capable of many modifications and variations without departing from the scope of the invention. Accordingly, the scope of the present invention is described by the claims appended hereto and supported by the foregoing.

What is claimed is:

1. A carton comprising:

top and bottom opposed walls hingedly interconnected by a pair of side walls to form a tubular body having an interior;

an end closure structure for at least partially closing each of opposite ends of said tubular body;

a buttress arrangement provided by each of said end closure structures, each of said buttress arrangements being disposed within said interior and extending vertically between said top and bottom walls to enhance the stacking strength of said carton; and an article dispenser provided at at least one of said opposite ends, said article dispenser at said at least one end being provided by a removable portion of said carton to define an opening for exposing articles for removal from said carton, said removable portion being defined by a frangible line extending across said top wall at a distance spaced from said at least one end, said frangible line further extending from said top wall across each of said side walls toward said bottom wall to a point on a fold line between said each side wall and said bottom wall, said point being positioned at a distance from said one end to control undesired tear of said side walls along said frangible line when said carton undergoes vertical compression, wherein a depressible tear initiation tab is defined in said top wall by a portion of said frangible line, said depressible tear initiation tab being disposed at a position offset from an upper end of either one of said buttress arrangements.

2. The carton of claim 1 wherein said each end closure structure comprises a pair of side end flaps joined to said side walls respectively, each of said side end flaps comprising a proximal portion hingedly connected to a respective one of said side walls and extending toward the other side wall, one of said side end flaps further comprising a distal portion hingedly connected to said proximal portion of said one side end flap, said distal portion of said one side end flap extending into said interior to form a respective one of said buttress arrangements.

3. The carton of claim 2 wherein the other one of said side end flaps of said each end closure structure further comprises a distal portion extending into said interior, said distal portions of said side end flaps of said each end closure structure being disposed in a face-to-face relationship with one another to form said respective buttress arrangement.

4. The carton of claim 2 wherein said distal portion of said one side end flap is positioned such that said distal portion is disposed between articles within said carton to serve as a partition.

5. The carton of claim 2 wherein said distal portion of said one side end flap extends all the way between said top and bottom walls to be in abutment at upper and lower ends thereof on inside surfaces of said top and bottom walls, and wherein said depressible tear initiation tab is disposed at a position offset from said upper end of said distal portion of said one side end flap.

6. The carton of claim 1 wherein said buttress arrangement at said one end of said tubular body is removable from said carton along with said removable portion to permit said articles to be dispensed from said carton.

7. The carton of claim 1 wherein said frangible line extending across said each side wall is curved at least in part.

8. The carton of claim 1 wherein said frangible line further extends from each of said points to an end edge of said bottom wall at said one end of said tubular body and still further extends at least partially along said end edge of said bottom wall to form an endless line, wherein a portion of said frangible line along said end edge of said bottom wall comprises means for keeping said removable portion attached to said tubular body.

9. The carton of claim 8 wherein said frangible line extends entirely along said end edge of said bottom wall and further along part of each of said fold lines between said point on said each fold line and said end edge of said bottom wall so that no part of said bottom wall is removed from said tubular body together with said removable potion.

10. The carton of claim 8 wherein said frangible line extends along part of said end edge of said bottom wall, a portion of said frangible line connecting between said each point and said end edge of said bottom wall being formed in said bottom wall, said portions of said frangible line extending divergently from said end edge to said points.

11. The carton of claim 1 wherein said removable portion consists of a portion of said top wall, a portion of each of said opposing side walls, and a portion of a respective one of said end closure structures.

12. The carton of claim 8 wherein said removable portion is hingedly connected to said bottom wall along a portion of said frangible line extending along said end edge of said bottom wall so that said removable portion remains connected to said carton by said portion.

13. The carton of claim 3 wherein said each side end flap includes a vertical fold line dividing said each side end flap into said distal and proximal portions, said distal portion having a horizontal transverse size greater than a horizontal transverse size of said proximal portion.

14. A carton comprising:

top and bottom opposed walls hingedly interconnected by a pair of side walls to form a tubular body having an interior;

an end closure structure for at least partially closing each of opposite ends of said tubular body; and an article dispenser provided at one of said opposite ends by a removable portion of the carton to define an opening for exposing articles for removal from said carton, said removable portion being at least partially defined by a frangible line, said frangible line comprising:

a first portion formed in said top wall and extending between opposite side edges of said top wall at a first distance spaced from said one end, part of said first portion defining a tear initiation tab in said to wall;

a second portion formed in one of said side walls and extending from one of said side edges of said top wall to a point on a lower edge of said one side wall;

a third portion formed in the other of said side walls and extending from the other side edge of said top wall to a point of a lower edge of said other side wall; and a fourth portion extending at least partially along an end edge of said bottom wall at said one end of said tubular body such that said second and third portions are interconnected by said fourth portion, wherein each of said points on said lower edges is positioned at a second distance from said one end of said tubular body to control undesired tear of said side walls along said frangible line when said carton undergoes vertical compression, said first distance being substantially greater than said second distance to facilitate development of breaking of said frangible line from said top wall toward said bottom wall.

15. The carton of claim 14 wherein said second and third portions are curved in at least in part.

16. The carton of claim 14 wherein said fourth portion extends entirely along said end edge of said bottom wall and further along part of each of said lower edges of said side walls between said point on said each lower edge and said end edge of said bottom wall so that no part of said bottom wall is removed from said tubular body together with said removable portion.

17. The carton of claim 14 wherein said fourth portion extends in part along said end edge of said bottom wall and in part formed in said bottom wall to connect said each point to said end edge of said bottom wall, sub-portions of said fourth portion connecting between said points to said end edge of said bottom wall extending divergently from said end edge to said points, said sub-portions being disposed continuous with said second and third portions respectively such that when the carton is in blank form, no corner is defined between each of said sub-portions and an adjacent one of said second and third portions.

18. The carton of claim 14 wherein said removable portion consists of a portion of said top wall, a portion of each of said opposing side walls, and a portion of a respective one of said end closure structures.

19. The carton of claim 14 wherein said removable portion is hingedly connected to said bottom wall along part of said fourth portion extending along said end edge of said bottom wall so that said removable portion remains connected to said carton by said part of said fourth portion.

20. A carton comprising:

top and bottom opposed walls hingedly interconnected by a pair of side walls to form a tubular body having an interior;

an end closure structure for at least partially closing each of opposite ends of said tubular body; and a buttress arrangement provided by each of said end closure structures, each of said buttress arrangements being disposed within said interior and extending vertically between said top and bottom walls to enhance the stacking strength of said carton, wherein said each end closure structure comprises a pair of side end flaps joined to said side walls respectively, each of said side end flaps of said each end closure structure comprising a proximal portion hingedly connected to a respective one of said side walls, and a distal portion hingedly connected to said proximal portion, said proximal portions extending from said side walls toward each other and together providing a wall spanning a width entirely between said side walls, said distal portions extending from said proximal portions into said interior and being disposed in a face-contacting relationship with each other to form a respective one of said buttress arrangements, wherein said each side end flap includes a vertical fold line dividing said each side end flap into said distal and proximal portions, said distal portion having a horizontal transverse size greater than a horizontal transverse size of said proximal portion, and wherein said each end closure structure further comprises a pair of upper and lower end flaps hingedly connected to said top and bottom walls respectively, each of said upper and lower end flaps is glued to both said proximal portions of a respective one of said end closure structure.

21. The carton of claim 20 wherein said respective buttress arrangement is positioned such that said respective buttress arrangement is disposed between articles within said carton to serve as a partition.

22. The carton of claim 21 wherein each of said distal portions of said respective buttress arrangement extends all the way between said top and bottom walls to be in abutment at upper and lower ends thereof on respective inside surfaces of said top and bottom walls.

* * * * *